US006022243A

United States Patent [19]

Yang et al.

[11] Patent Number: 6,022,243

[45] Date of Patent: Feb. 8, 2000

[54] BOARD LOCK

[75] Inventors: Johnson Yang, Tai-Shan; Kun-Tsan Wu; Chin-Yi Lai, both of Tu-Chen, all of Taiwan

[73] Assignee: Hon Hai Precision Ind. Co., Ltd., Taipei Hsien, Taiwan

[21] Appl. No.: 09/344,173

[22] Filed: Jun. 24, 1999

[30] Foreign Application Priority Data

Dec. 15, 1998 [TW] Taiwan ..... 87220870

[51] Int. Cl.[7] ..... H01R 13/73

[52] U.S. Cl. ..... 439/567

[58] Field of Search ..... 439/567, 571–573

[56] References Cited

U.S. PATENT DOCUMENTS 5,171,165 12/1992 Hwang ..... 439/567

5,423,696 6/1995 Sato ..... 439/567

5,797,769 8/1998 Yang et al. ..... 439/567

5,807,135 9/1998 Clark ..... 439/567

5,865,645 2/1999 Embo et al. ..... 439/567

*Primary Examiner*—Gary F. Paumen

*Attorney, Agent, or Firm*—Wei Te Chung

[57] ABSTRACT

A board lock includes a fixed section adapted to be fixed to a connector and a pair of spaced legs connected to the fixed section by means of a resilient section. The legs lie in a plane which is substantially normal to the fixed section and are arranged on opposite sides of the fixed section. The legs form convex portions arranged on opposite sides of the plane thereof for engaging with an edge of a hole of a circuit board into which the legs are inserted thereby securely and stably retaining the connector on the circuit board.

12 Claims, 8 Drawing Sheets

BOARD LOCK

BACKGROUND OF THE INVENTION

1. Field of the Invention

The present invention generally relates to a board lock for retaining a connector on a circuit board, and in particular to a board lock which is stably mounted on a circuit board with a low insertion force.

2. The Prior Art

Electrical connectors are commonly retained on a circuit board by means of board locks. Examples of board locks are disclosed in Taiwanese Patent Application Nos. 81205296 and 81213628 as shown in FIGS. 1 and 2, respectively.

Referring to FIG. 1, a conventional board lock 80 comprises a fixed section 83 forming a bore 830 for receiving a bolt 85 to secure the board lock 80 to a connector 86. A pair of legs 81 are offset from and parallel to the fixed section 83 and connected thereto by means of a connection section 82. Each leg 81 has a barb 811 formed thereon for engaging with a circumferential edge of a hole 841 defined in a circuit board 84 thereby retaining the connector 86 on the circuit board 84. The legs 81 and barbs 811 of the board lock 80 lie in the same plane.

In FIG. 2, a conventional board lock 90 comprises a fixed section 92 received in a cavity 931 defined in a connector 93. Two legs 91 extend from the fixed section 92 and are coplanar therewith. Each leg 91 forms a barb 911 coplanar with the leg 91 for engaging with a hole 941 defined in a circuit board 94.

The legs of the conventional board locks are substantially flat and the barbs thereof are coplanar with the legs thereby rendering the legs rigid during insertion into a hole defined in a circuit board and possibly damaging the hole of the circuit board. Furthermore, the flat configuration does not promote stable retention of the board lock in the hole.

Thus, it is desired to provide a board lock that eliminates the problems discussed above.

SUMMARY OF THE INVENTION

Accordingly, an object of the present invention is to provide a board lock which does not damage a hole of a circuit board during insertion.

Another object of the present invention is to provide a board lock which is stably retained in a circuit board.

To achieve the above objects, a board lock in accordance with the present invention comprises a fixed section adapted to be fixed to a connector and a pair of spaced legs connected to the fixed section by means of a resilient section. The legs lie in a plane which is substantially normal to the fixed section and are arranged on opposite sides of the fixed section. The legs form convex portions arranged on opposite sides of the plane thereof for engaging with an edge of a hole of a circuit board into which the legs are inserted thereby securely and stably retaining the connector on the circuit board.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
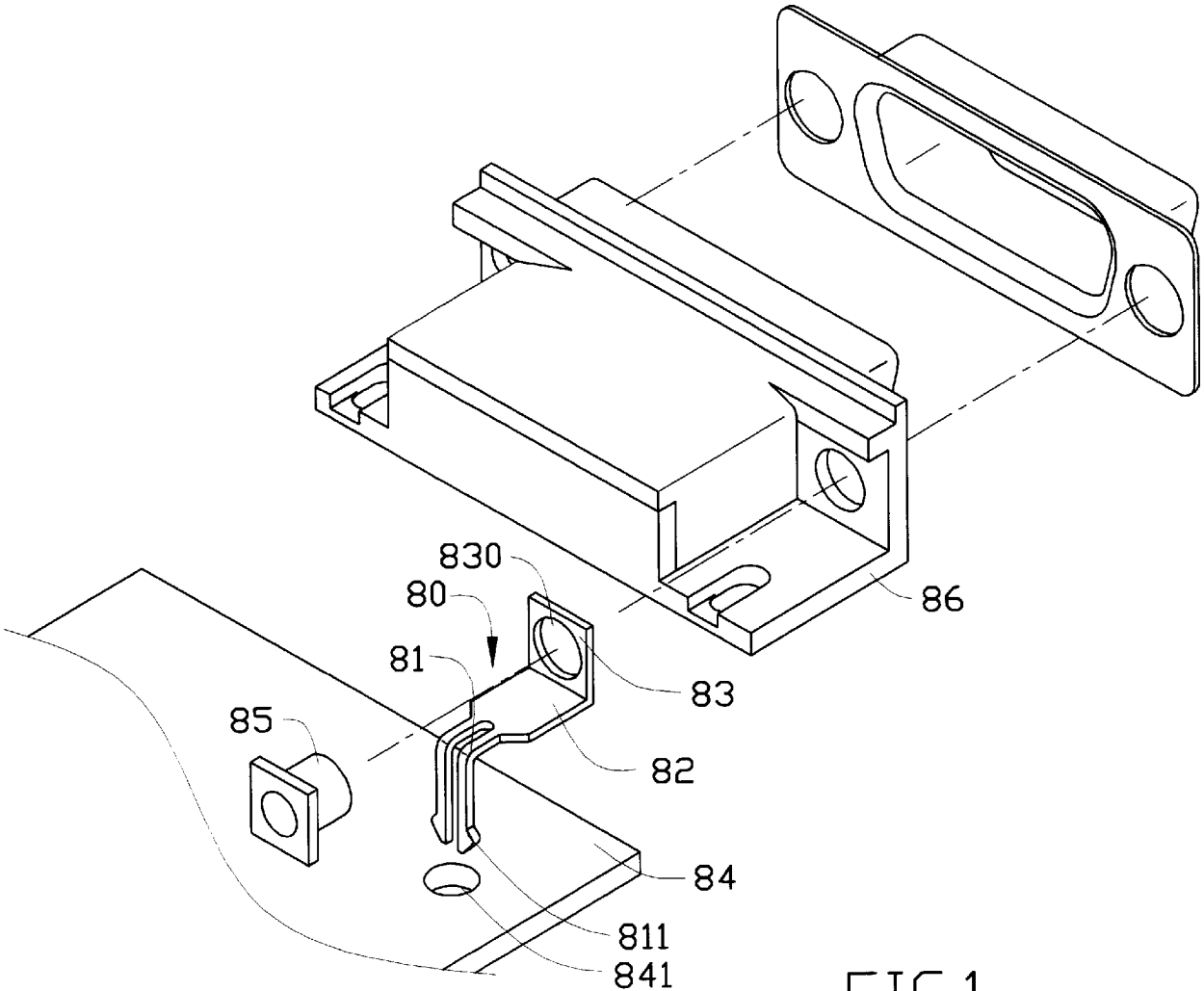
FIG.1 PRIOR ART
FIG. 1 is an exploded view of a connector to be mounted on a circuit board by means of a conventional board lock.
Figure 2:
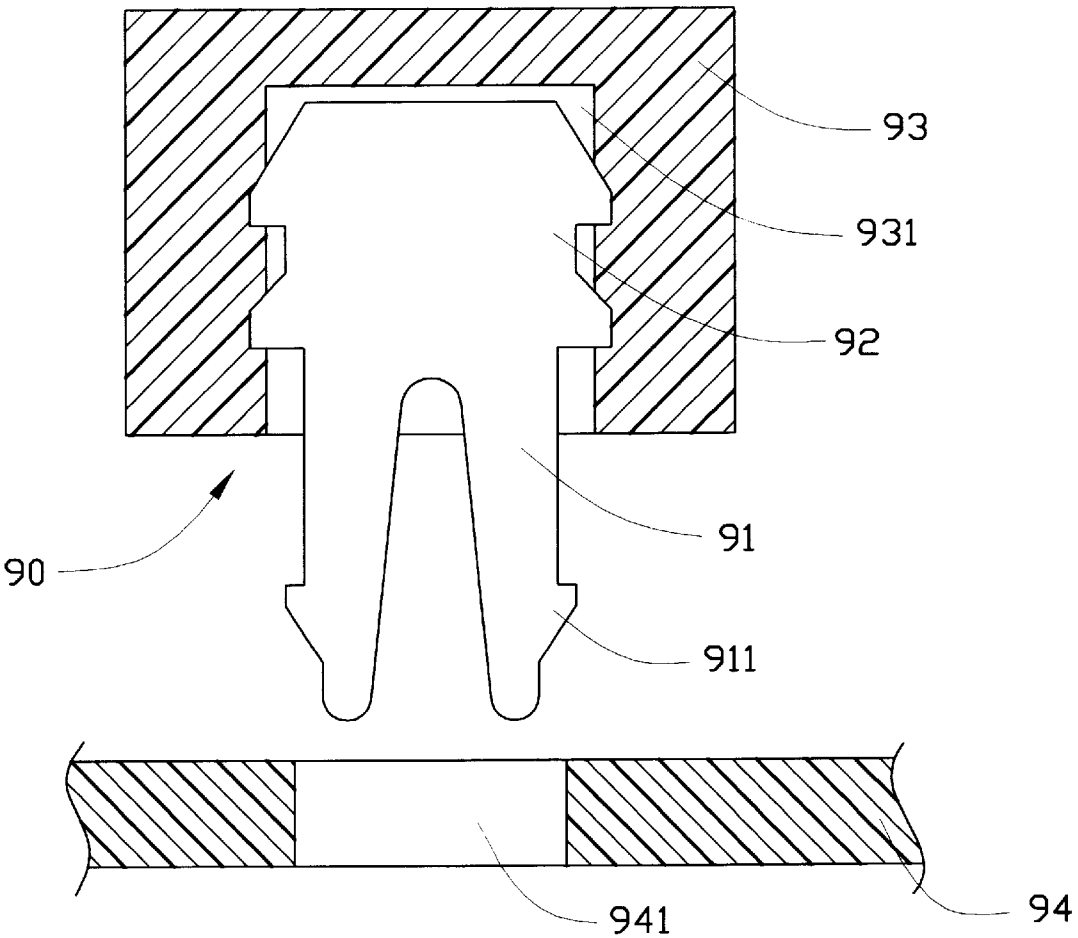
FIG.2 PRIOR ART
FIG. 2 is a partial, cross-sectional view of a connector to be mounted on a circuit board by means of another conventional board lock.
Figure 3:
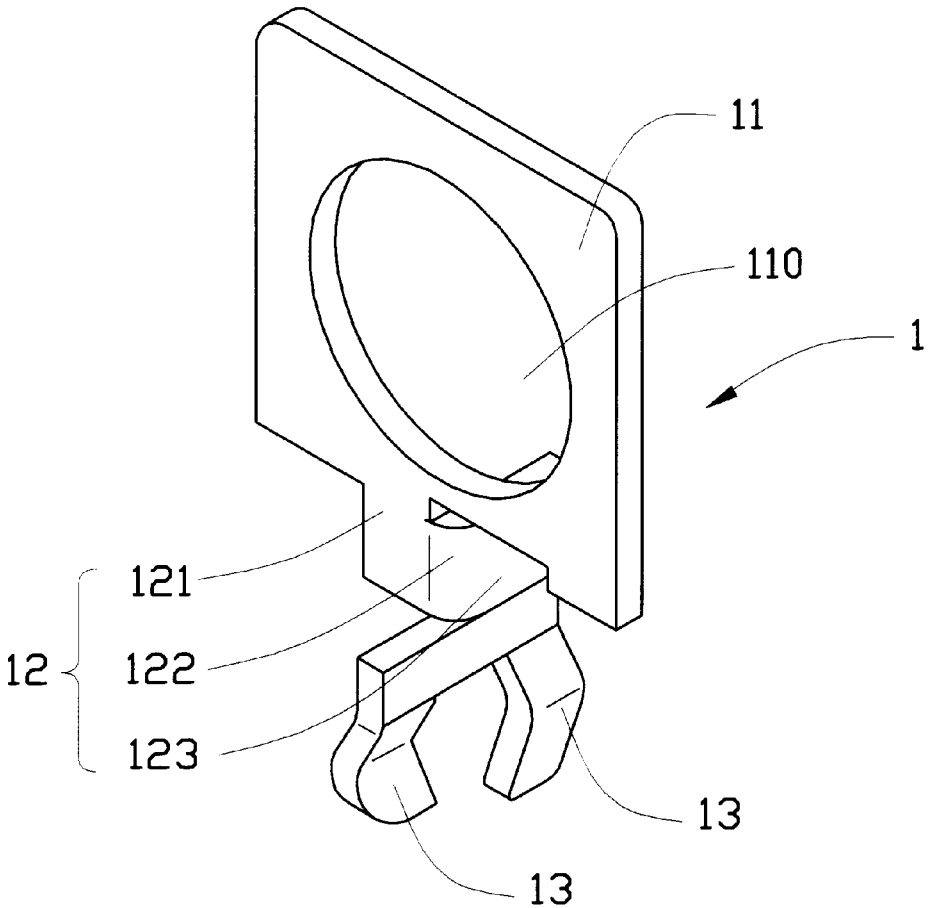
FIG. 3 is a perspective view of a board lock constructed in accordance with the present invention.
Figure 5:
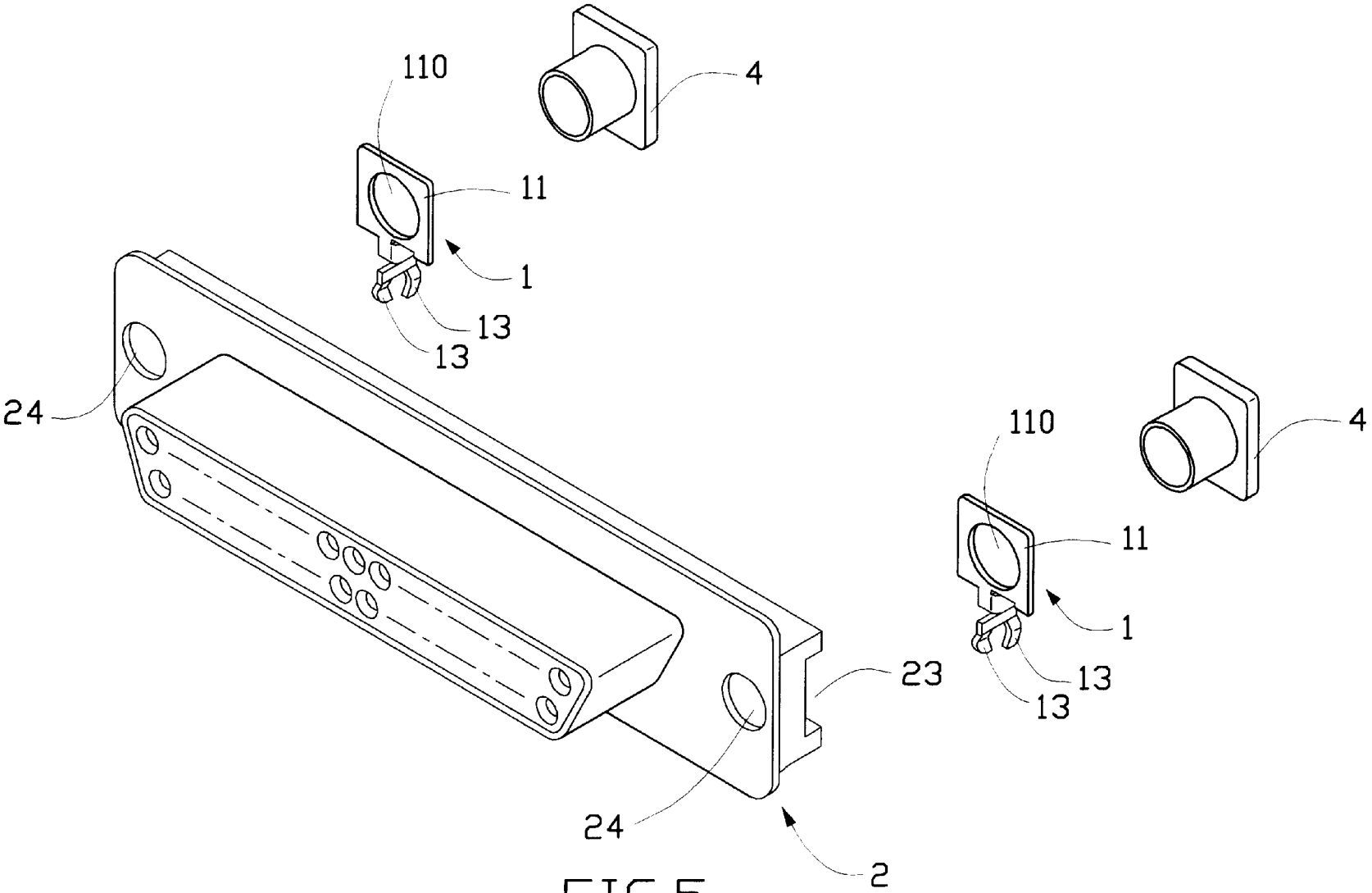
FIG. 5 is an exploded view of a connector to which the board locks of the present invention are mounted.

Referring to the drawings and in particular to FIGS. 3 and 5, a board lock 1 in accordance with the present invention comprises a flat fixed section 11 defining a bore 110 therein for receiving a bolt 4 to fix the board lock 1 to a connector 2. An intermediate section 12 extends from a lower edge of the fixed section 11 and supports a pair of spaced similar legs 13 downwardly extending therefrom. The intermediate section 12 comprises a vertical portion 121 extending from a lower edge of the fixed section 11 and substantially coplanar therewith and a horizontal portion 123 substantially normal to the vertical portion 121 and connected thereto by means of a bent portion 122. The intermediate section 12 provides resiliency between the legs 13 and the fixed section 11.

Figure 4A:
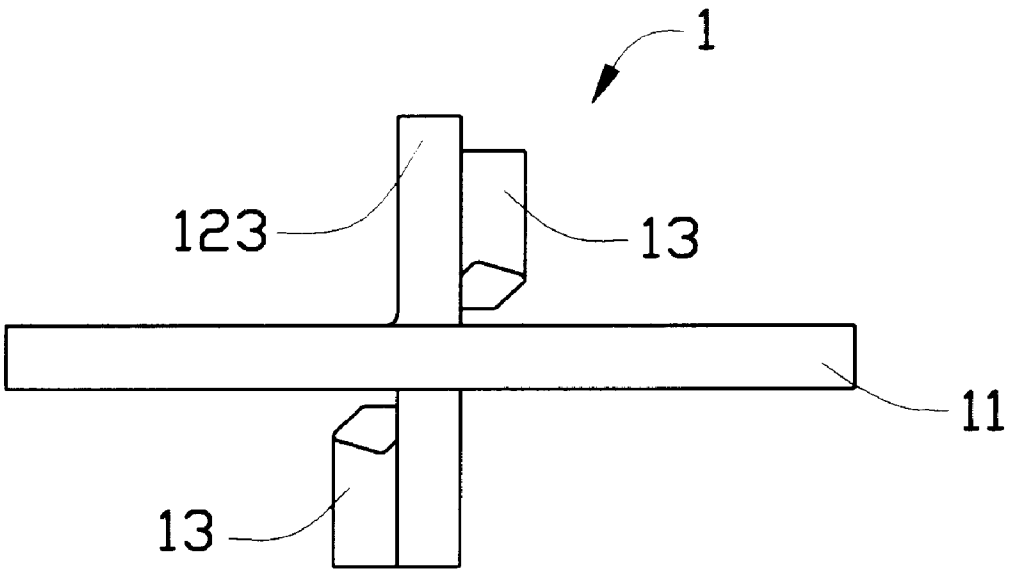
FIG. 4A is a top view of FIG. 3.
Figure 4B:
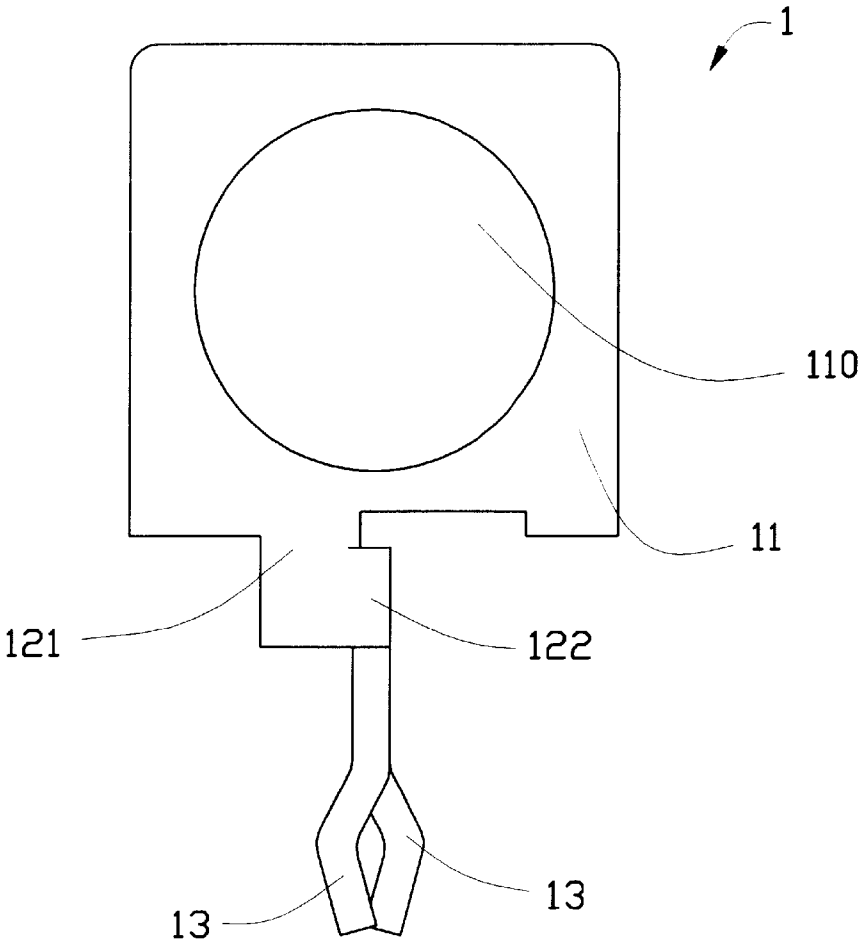
FIG. 4B is a front view of FIG. 3.
Figure 4C:
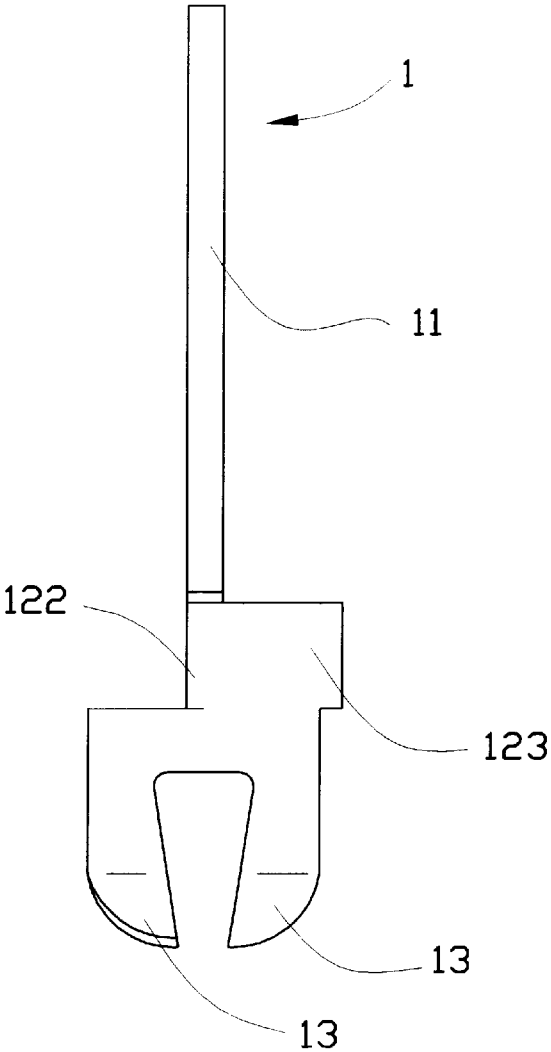
FIG. 4C is a side elevational view of FIG. 3.

The horizontal portion 123 lies in a plane, which is substantially normal to the plane that the fixed section 1 lies in, and which generally intersects the plane that the fixed section 11 lies in around the centerline of the fixed section 11. The legs 13 lie substantially in the same plane as the horizontal portion 123 and are distanced from each other whereby the two legs 13 are located on opposite sides of the fixed section 11 as shown in FIGS. 4A and 4C. Each leg 13 forms a convex portion (not labeled) extending in opposite directions with respect to the horizontal portion 123 whereby the legs 13 are located at opposite sides of the horizontal portion 123 as shown in FIGS. 4A and 4B. Preferably, the legs 13 are formed on opposite ends of the horizontal portion 123 as shown in FIG. 4C As shown in FIG. 5, a bolt 4 extends through the bore 110 of the corresponding board lock 1 and through a hole 24 defined in the connector 2 for securing the board lock 1 to the connector 2. Preferably, a recess 23 is defined in the connector 2 for receiving the fixed section 11 of the board lock 1 therein.

Figure 6:
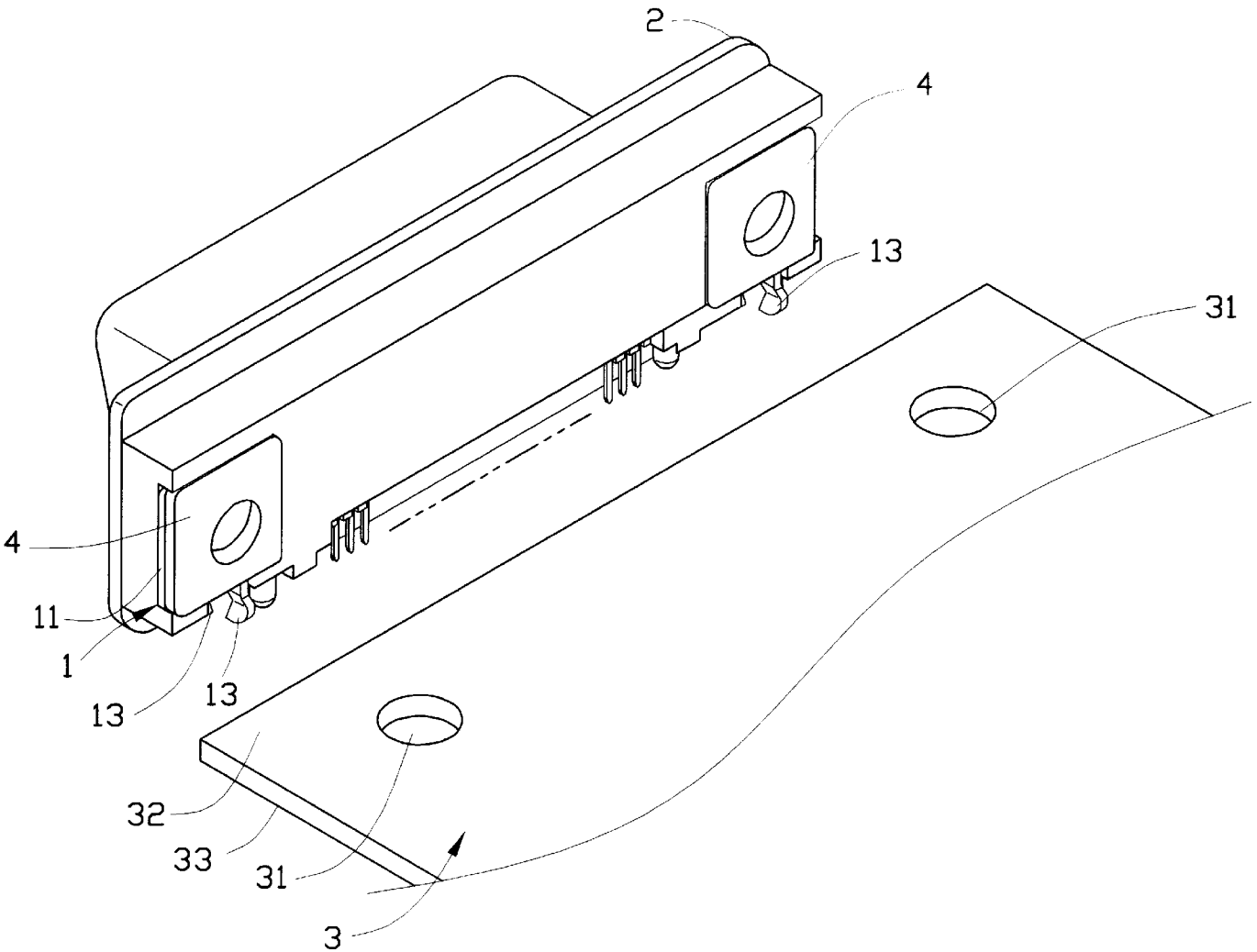
FIG. 6 is a perspective view of a connector with board locks of the present invention fixed therein and a circuit board.

Further referring to FIG. 6, each board lock 1 mounted to the connector 2 engages with a corresponding hole 31 defined in a circuit board 3 for mounting the connector 2 thereon. The connector 2 is positioned on a top face 32 of the circuit board 3 with the legs 13 of each board lock 1 extending through the corresponding hole 31. The hole 31 has a diameter substantially corresponding to the distance between outer edges of the legs 13 for securely retaining the legs 13 therein. The convex portions of the legs 13 engage with a bottom face 33 of the circuit board 3 thereby securely retaining the connector 2 on the circuit board 3. The arrangement of the legs 13 on opposite sides of the fixed section 11 and the convex portions formed on opposite sides of the horizontal portion 123 further ensure stable retention of the board lock 1 in the hole 31. Furthermore, such a symmetrical mirror-image arrangement facilitates automatic centering of the board lock 1 in the hole 31. Moreover, the intermediate section 12 positioned between the legs 13 and the fixed section 11, may provide resiliency thereof to facilitate assembling between the legs and the corresponding hole 31 in the circuit board 3.

Although the present invention has been described with reference to the preferred embodiment, it is apparent to those skilled in the art that a variety of modifications and changes may be made without departing from the scope of the present invention which is intended to be defined by the appended claims.

What is claimed is:

1. A board lock adapted to mount a connector to a circuit board comprising:

a flat fixed section comprising means for attaching the board lock to the connector, the fixed section lying in a first plane;

an intermediate section comprising a vertical portion extending from and substantially coplanar with the fixed section and a flat horizontal portion connected to the vertical portion by a bent portion, the horizontal portion lying in a second plane which is substantially normal to the first plane; and a pair of legs extending from the horizontal portion of the intermediate section and distanced from each other along the second plane, each leg forming a convex portion located at opposite sides of the horizontal portion of the intermediate section, the legs being adapted for insertion into a hole defined in the circuit board to retain the connector thereon by engagement of the convex portions of the legs with an edge of the hole.

2. The board lock as claimed in claim 1, wherein the legs are arranged on opposite sides of the fixed section.

3. The board lock as claimed in claim 1, wherein a distance between outer edges the legs substantially corresponds to a diameter of the hole of the circuit board.

4. The board lock as claimed in claim 1, wherein the means for attaching to the connector comprises a bore defined in the fixed section adapted to receive a fastener for securing the board lock to the connector.

5. A board lock comprising a fixed section adapted to be fixed to a first object and a pair of spaced legs extending from a lower edge of the fixed section adapted to be inserted into a hole defined in a second object for mounting the first object to the second object, the legs lying on opposite side of a first plane, each leg forming a barb extending in a direction substantially normal to the first plane for engaging with an edge of the hole;

wherein the fixed section lies in a second plane which is substantially normal to the first plane; and wherein the legs are arranged on opposite sides of the second plane.

6. The board lock as claimed in claim 5, wherein the barbs are located on opposite sides of the first plane.

7. The board lock as claimed in claim 5, wherein the barbs are convex portions formed on the legs.

8. The board lock as claimed in claim 5, wherein a resilient section is formed between the fixed section and the legs for supporting the legs.

9. An electrical connector for mounting on a circuit board, comprising:

a board lock including:

a fixed section attached to the connector;

an intermediate section extending from a lower edge of the fixed section, and including at least a horizontal portion lying in a plane perpendicular to said fixed section; and a pair of retention legs extending downward from the horizontal portion in a symmetrical manner with each other;

wherein said pair of retention legs are on opposite sides of a plane in which the fixed section lies.

10. The connector as claimed in claim 9, wherein said retention legs are substantially perpendicular to said fixed section.

11. The connector as claimed in claim 9, wherein said fixed section and said pair of retention legs are mutually symmetrical.

12. The connector as claimed in claim 9, wherein said intermediate section includes a vertical portion extending downward from the lower edge of the fixed section, thereby bridging the fixed section and the horizontal portion.

* * * * *